US005347440A

United States Patent [19]

Roberts et al.

[11] Patent Number: 5,347,440

[45] Date of Patent: Sep. 13, 1994

[54] PORTABLE LIGHT

[75] Inventors: Stephen A. Roberts, Orange County, Calif.; Leo B. Roberts, St. Louis County; Ronald R. Klawitter, Franklin County, both of Mo.

[73] Assignee: Roberts Marketing, Inc., St. Louis, Mo.

[21] Appl. No.: 48,835

[22] Filed: Apr. 12, 1993

[51] Int. Cl.[5] ..... F21L 7/00

[52] U.S. Cl. ..... 362/200; 362/196

[58] Field of Search ..... 362/200, 196, 203, 201, 362/189

[56] References Cited

U.S. PATENT DOCUMENTS

| | | | |
|---|---|---|---|
| D. 298,658 | 11/1988 | Roberts et al. | D26/37.50 |
| 3,717,759 | 2/1973 | Rozisseau | 362/203 |
| 4,559,588 | 12/1985 | Engelson et al. | 362/196 |
| 4,774,638 | 9/1988 | Caires | 362/200 |
| 4,914,545 | 4/1990 | Price | 362/200 |
| 5,183,324 | 2/1993 | Thomas | 362/200 |

*Primary Examiner*—Ira S. Lazarus
*Assistant Examiner*—L. Heyman
*Attorney, Agent, or Firm*—Polster, Lieder, Woodruff & Lucchesi

[57] ABSTRACT

A portable electric lamp has a flat sided body that contains one or more batteries to power a lamp bulb, and an enclosure which has a light-transmitting lens portion, the enclosure housing the lamp bulb. The enclosure is mounted for sliding movement on and with respect to the body. A switch, a battery contact of which is carried by the enclosure, moves with the enclosure, into and out of contact with the battery to energize and de-energize the lamp bulb. In the embodiment described, the body is made up of two cavities, hinged along a long edge. An opposite long edge is provided with tabs on which mounting lugs are provided that fit into channels in the enclosure to permit sliding and to mount the enclosure on the body. The assembled lamp has no protrusions, as distinguished from lamps with switch buttons extending from them.

13 Claims, 2 Drawing Sheets

PORTABLE LIGHT

BACKGROUND OF THE INVENTION

The portable lamp of this invention will be described terms of a purse light, but it is adaptable to use in a tackle box, or briefcase or almost any other kind of container the interior of which can desirably be illuminated. It is also useful, when removed from the container, as a keyhole illuminator or the like.

Pocket flashlights have been known for many years, and even purse illuminators adapted to be mounted detachably in a purse, as shown, for example in U.S. Pat. No. 298,658.

The present invention is directed to a purse light or the like which is simple, flat-sided, with no protrusions whatsoever, clean-looking, effective, easy to use, and inexpensive.

SUMMARY OF THE INVENTION

In accordance with this invention, generally stated, a portable electric lamp is provided that includes a body flat on its front and back surfaces and containing one or more batteries to power a lamp bulb, an enclosure having a light-transmitting lens portion, the enclosure housing the lamp bulb, means for mounting the enclosure for sliding movement with respect to the body, and switch means, internal of the body and enclosure, responsive to the sliding movement to connect the bulb electrically to the battery.

In the preferred embodiment, the body and enclosure are made of plastic, each in one piece. The body is formed with an integral hinge along a long edge of two cavities in which batteries are housed. Along long edges of the cavities opposite the hinge, the cavities are provided with tabs carrying lugs, which, when the cavities are folded together, snap into channels in the enclosure. The lugs and channels are so proportioned and arranged as to permit the enclosure to slide relative to the body. The integral hinge is resilient, biasing the cavities toward open position, and the tabs, cooperating with the enclosure, constitute the sole means for holding the cavities in closed position to form the body. In the preferred embodiment described, the cavities, when folded together, form a housing in which two triple A batteries are contained. The body and enclosure are each formed in one piece. An electrical circuit, in the preferred embodiment, is made up of three metal stampings, a bulb holding strip of electrically conductive material with a long reach in which a socket is formed for receiving a lamp bulb and a contact extending from the long reach, positioned to make and break contact with a terminal of a battery, the lamp bulb holding strip being mounted in and fixed against movement with respect to the enclosure; a bulb terminal strip of electrically conductive material fixedly mounted in the body with a long reach generally parallel to the long reach of the bulb holding strip and in a position resiliently to engage a terminal in the base of the lamp bulb and with a battery contact part positioned constantly to engage a terminal of a battery of opposite polarity from the terminal engaged by the bulb holding strip, and a bridging strip of electrically conductive material, mounted in the body and providing electrical connection between terminals of opposite polarity of the the two batteries of the preferred embodiment.

Detent means are provided to inhibit accidental sliding displacement of the enclosure with respect to the body. Preferably, a rear flat surface of the body is provided with a strip of a hooked element of a hook and loop type fastener of the type sold under the trademark "Velcro" and the purse or other receptacle in which the lamp is to be mounted, is provided with a strip of the element with loops on it.

DESCRIPTION OF THE PREFERRED EMBODIMENT

Figure 1:
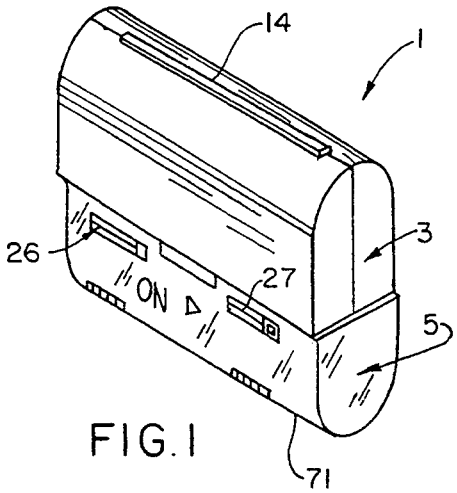
FIG. 1 is a view in perspective of one embodiment of portable lamp of this invention.

Referring now to the drawing for one illustrative embodiment of this invention, reference 1 indicates a fully assembled lamp. The lamp 1 includes a body 3 and a lens-enclosure 5.

Figure 10:
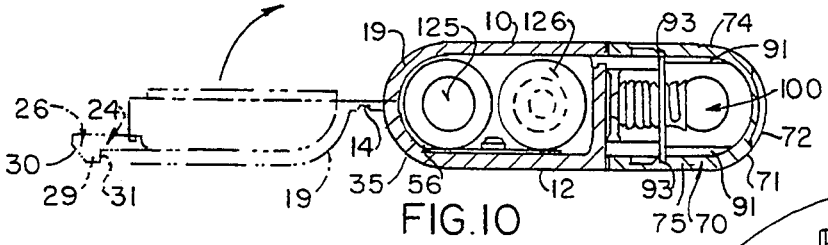
FIG. 10 is a sectional view taken along line 10—10 of FIG. 8, but with the body in its closed position, the open position being shown in phantom lines.

The body 3 is made up of an upper cavity 10 and a lower cavity 12, as viewed in FIG. 10. The two cavities are joined by a hinge 14 integral with and along two long edges of the cavities.

Figure 8:
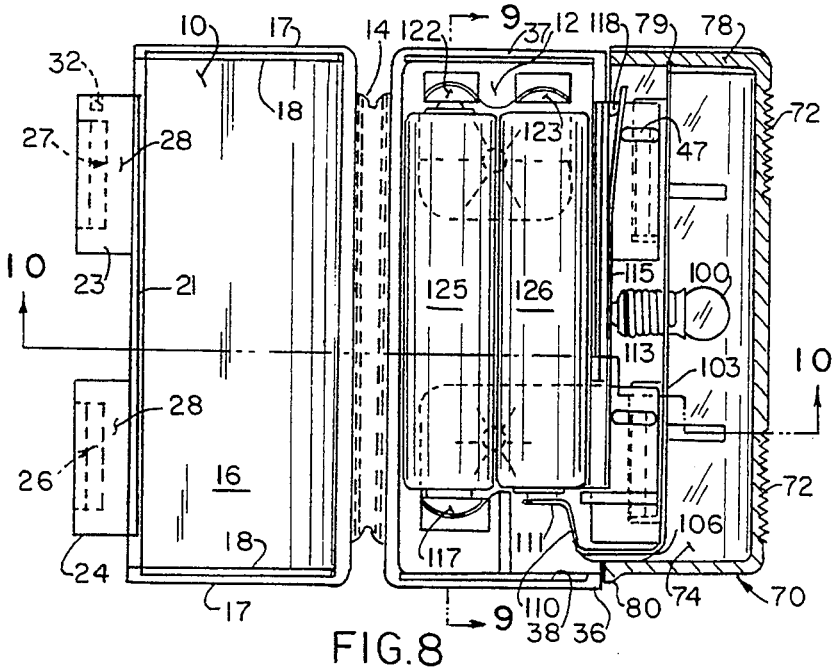
FIG. 8 is a top plan view, partly in section, showing a body of the lamp in its open condition and an enclosure, in section.
Figure 11:
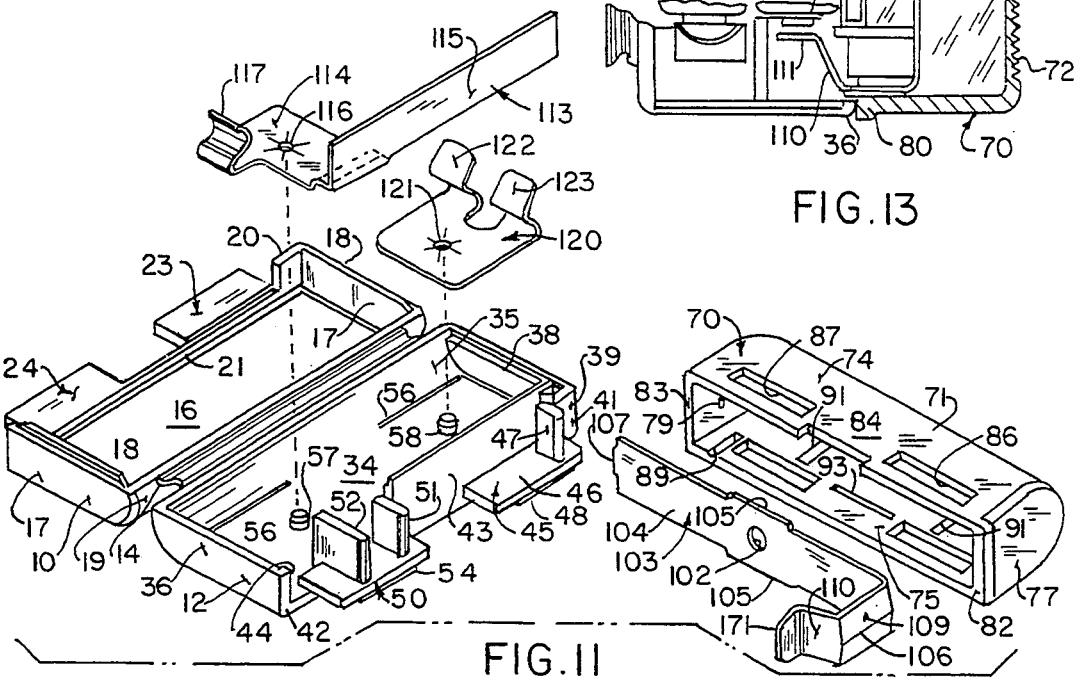
FIG. 11 is an exploded view in perspective of the parts making up the lamp, without a bulb or batteries.

The upper cavity 10 has a flat bottom as viewed in FIGS. 8 and 11, with an inside surface 16, end walls 17, from each of which a bead 18 extends along an inner edge, a curved upper wall 19 and a lower corner wall 20. A low wall or rib 21 extends between the corner wall 20 and end wall 17. Two upper cavity tabs 23 and 24, integral at one end with the rib 21, project outwardly. The tab 24, on the near side as viewed in FIGS. 10 and 8, has an outwardly projecting lug 26; the tab 23, on the far side, has an identical tab 27. Each of the lugs has at its outer edge a lip 29 with a beveled leading edge 30 and a retaining edge or step 31. The far side tab 23 has, on the same side as the lug 27, a stop 32, shown in dotted lines in FIG. 8 and in top elevation in FIG. 2.

Figure 9:
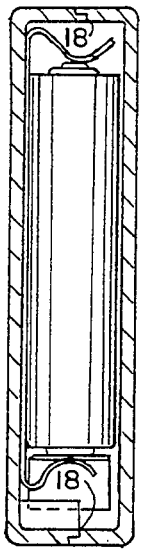
FIG. 9 is a sectional view taken along line 9—9 of FIG. 8.

The lower cavity 12 has a flat bottom with an inside surface 34, a curved upper wall 35, a near end wall 36, and a far end wall 37. The end walls 36 and 37 have a rabbet 38 to receive the bead 18, to form a rabbet joint when the body is assembled, as shown in FIG. 9. The lower cavity has a corner wall 39 at the lower end of the end wall 37. The corner wall 39 has a flat outer surface 41, which lies in a common plane with a flat surface 42 of the near end wall 36. A lower wall 43, inboard of the corner wall 39, extends from an inboard surface of the end wall 37 toward, but short of the end wall 36, leaving a gap 44 between them. The lower cavity also has two tabs, a far tab 45, and a near tab 50. The far tab 45 has a post 47 on an upper surface, and on a lower surface, a lug 48 identical in construction to the lug 27 of the tab 23. The near tab 50 has on its upper surface (as viewed in FIG. 11) a post 51 and, spaced from the post 51 in a direction toward the wall 36, a wall 52. The tab 50 has on its lower surface a lug 54, which is identical in its construction to the lug 26. At the meeting line of the bottom surface 34 and the curved upper wall 35 seats 56 are formed, as shown in FIGS. 10 and 11, and the surface 34 has, projecting upwardly from it, mounting pins 57 and 58.

The body 3 is designed to be made in one, single, unitary piece of high-impact plastic.

The body 3 has a flat outside back surface, on which a strip 130 of one element of a hook and loop fastener material is mounted. In the preferred embodiment, the element 130 that is mounted on the flat back surface is the one with hooks 131 on it, and the complementary looped element is mounted in a purse or other receptacle, to which the lamp can then be removably mounted.

Figure 7:
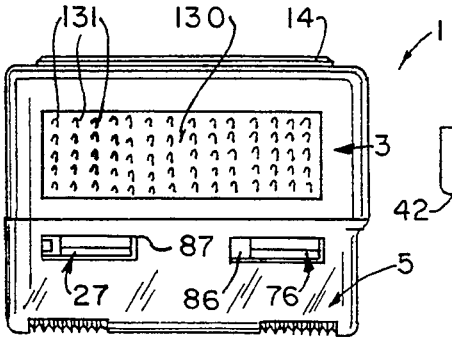
FIG. 7 is a view in rear elevation.
Figure 12:
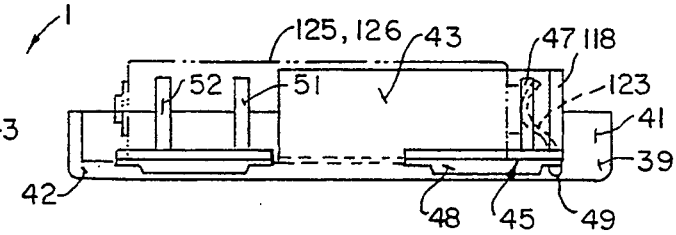
FIG. 12 is a view in side elevation of one of two cavities making up the body of the lamp.

The lens-enclosure 5 is also made of plastic. It has a rounded, translucent bottom 71, in which diffusing prisms 72 are molded near opposite ends of the outside surface of the bottom, as shown particularly in FIGS. 2, 3, and 7. The rest of the enclosure can be made opaque if desired, either by the nature of the plastic or by coating inner or outer surfaces. The enclosure has an upper side wall 74 and a lower side wall 75, as viewed in FIG. 10. The side walls 74 and 75 are substantially parallel. but for a slight draft for ease in their production. A near end wall 77 and a far end wall 78 bridge between the side walls 74 and 75. The far end wall 78 is substantially planar on its outside surface. The near end wall 77 has a fillet 80 along its free edge. The outer surface of the fillet 80 and of the side wall 75 and end wall 78 lie in a common plane. The free edge of the side wall 74 also lies in that plane, except for a notch 84 in the center of the upper edge. The notch 84 is provided to facilitate the separation of the body from the enclosure.

A pair of near slots 86 in the two side walls 74 and 75 are aligned laterally, and aligned longitudinally with a pair of far slots 87. All of the slots 86 and 87 run parallel with the plane of the upper surface 82 of the side and end walls, and in this embodiment, extend entirely through the side walls 74 and 75. Adjacent the slot 87 in the side wall 75, and between the end of the slot 87 and the inside surface of the end wall 78, is a detent receiver 89, extending perpendicularly to the plane of the surfaces 82 and 83. Ribs or corbels 91 project inwardly from the inner surfaces of both the side walls 74 and 75, perpendicular to the long axis of the slots 86 and 87, and terminating a short distance below the slots. The inner surface of the end wall 78 has a nitch 79 in it. In the inner surface of the side walls 74 and 75, between the ends of the slots 86 and 87 and slightly below them are grooves 93, parallel to the long axis of the slots and perpendicular to the corbels 91.

A lamp bulb 100 is screwed into a socket hole 102 in a switch strip 103. The switch strip 103 has a long reach 104, with wings 105 extending a short distance from side edges of the reach 104, as shown particularly in FIG. 11, and with a nose 107 at its free end which extends into the nitch 79. The wings 105 are seated in the grooves 93, and the side edges of the reach 104 are supported against movement downwardly in the enclosure by the corbels 91. The switch strip has at its end opposite the nose 107, an elbow 109, a recurred arm 110 and a finger-contact 111. A stiffening rib 106 extends height-wise of the elbow section 109. Thus, as can be seen in FIG. 8, the switch strip 103 is fixed against longitudinal movement by the nose 79 and the rib 106, and against height-wise movement by the corbels 91 and grooves 93, as well as the nose 107 in the nitch 79 and the post 51 and wall 52 of the tab 50.

A lamp base contact strip 113 has a long reach 115, integral with a mounting plate 114 and perpendicular to it, as shown particularly in FIG. 11. The mounting plate 114 has a star mounting aperture 116 which is forced down on the pin 57. An edge of the mounting plate 114 opposite the reach 115 is seated in the seat 56 adjacent the pin 57. A contact piece 317, also integral with the mounting plate 114, extends upwardly in the same direction, but perpendicularly to the long reach 115. The reach 115 extends along the outboard side of the wall 43, and is caged at its free end between the post 47 and deflector bead 118, to keep the reach 115 in constant contact with a base terminal of the lamp bulb. As can be seen, the lamp base contact strip 113 is mounted in the body 5 and fixed against movement., except to the extent that the reach 115 may flex in response to movement of the bulb 100 for a short distance along its length.

In the present embodiment, two triple A batteries 125 and 126 are employed. They are connected to one another in series by a bridging contact plate 120 with contacts 122 and 123 and a star mounting aperture 121. The pin 58 is forced into the aperture 121, and one edge of the plate 120 is seated in the seat 56 adjacent that pin. In this illustrative embodiment, a positive terminal of the battery 126 is oriented toward the finger contact 111 of the lamp-carrying switch strip 103. The negative terminal of the battery 126 is in contact with the contact 123 of the bridging contact 120. The battery 125 is reversely oriented, with the positive terminal in contact with the contact 122 and the negative terminal in contact with the contact 117 of the lamp base contact strip 113.

Figure 13:
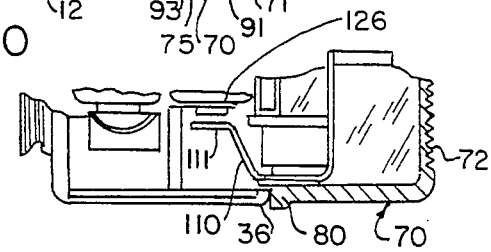
FIG. 13 is a fragmentary sectional view showing the switch in open condition.

In FIGS. 1 through 7 and 8, the device is shown in the position in which the bulb 100 is energized. In FIG. 13, the enclosure has been slid with respect to the body to the place at which the contact 111 is clear of the terminal of the battery 126, and the circuit is therefore broken and the bulb de-energized.

In manufacturing the lamp of this invention, it can be seen that only two plastic parts are required, and only three metal stampings. The stampings are of phosphor bronze, which makes them electrically conducting and springy enough to ensure good contact with the battery terminals and with the base of the bulb 100.

In assembling the lamp, the bulb 100 is screwed into the socket hole 102. The batteries are installed in the body as shown in FIG. 8, the wall 52 holding the battery 126 against the contact 123 and fixing the battery against movement in the direction of the contact finger 111. The upper cavity is folded over the lower cavity until the rabbeted edges of the end walls are seated as shown in FIG. 9, and the tabs 23 and 24 are aligned with the tabs 45 and 50. The lugs 26, 27, 48 and 54, are forced into the enclosure, aided by the beveled leading edges 30, until they clear the upper edges of the slots 86 and 87, when they snap into the slots 86 and 87, with the retaining ledges 31 contiguous the upper edges of the slots. This is made possible by the resilience of the tabs and of the side walls of the enclosure. When the body and enclosure are to be separated, a coin can be inserted in the notch 84, pressing down on the rib 21 of the upper cavity 10, forcing the lugs 26 and 27 out of the slots permitting them to be rocked around the lugs 48 and 54 until they clear the upper edge of the enclosure, a short distance. In the open circuit position, the far tab detent 49 is seated in the detent receiver 89. When the enclosure is slid manually to closed circuit position, the detent 49 is forced out of the detent receiver, thanks to the resilience of the tab and enclosure wall. The stop 32, projecting into the slot 47 in the front wall 75, holds the enclosure in circuit closing position until the enclosure is slid back manually over the stop.

Figure 2:
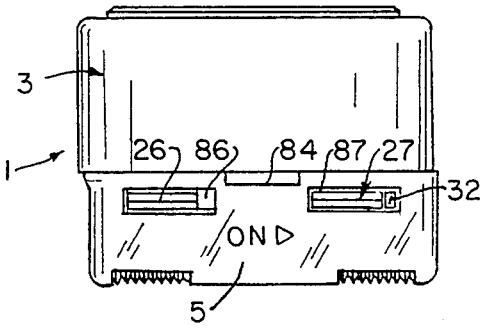
FIG. 2 is a view in front elevation.
Figure 3:
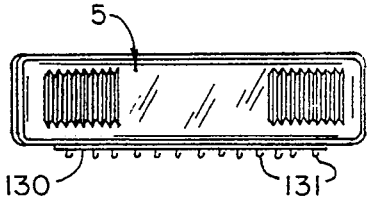
FIG. 3 is a bottom plan view.
Figure 4:
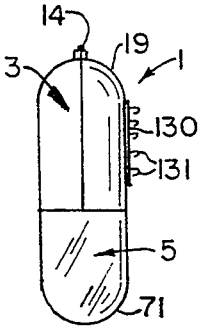
FIG. 4 is a view in end elevation, viewed from left to right in FIG. 2.
Figure 5:
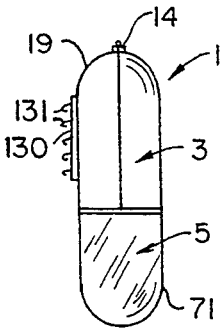
FIG. 5 is a view in end elevation, viewed from right to left in FIG. 2.
Figure 6:
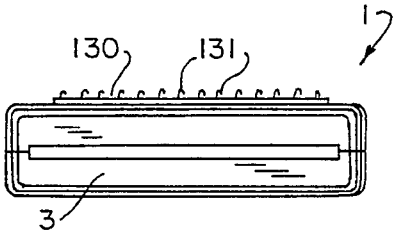
FIG. 6 is a top plan view.

It will be observed that there are no protrusions whatsoever from the assembled lamp. The hinge has been shown somewhat exaggeratedly in FIGS. 4 and 5 for clarity, but it is preferrably more nearly flat, as shown in FIGS. 1, 2, and 6. Because the switch is totally enclosed in the body and enclosure, there is no switch button projecting from them.

Numerous variations in the construction of the lamp of this invention within the scope of the appended claims will become apparent to those skilled in the art in the light of the foregoing disclosure. Merely by way of example, AA batteries can be used, although their use requires increasing the size of the body to accommodate them. Similarly, a different type of battery can be used with appropriate modification of the construction of the circuit members and cavities. The slots 86 and 87 can be made in the form of blind channels instead of extending entirely through the side walls of the enclosure. The shape and appearance of the lamp can be varied, although the one illustrated has clean lines and is very compact. These are merely illustrative.

Having thus described the invention, what is claimed and desired to be secured by Letters Patent is:

1. A portable electric lamp comprising front and back surfaces and containing battery means to power a lamp bulb, an enclosure having a light-transmitting lens portion, said enclosure housing said lamp bulb, means for mounting said enclosure for sliding movement with respect to said body, and switch means responsive to said sliding movement to connect said bulb electrically to said battery means, said body being made of plastic and formed of two cavities, hinged along a long edge parallel to a long axis of said enclosure, said edge being on an opposite edge of said body from said means for mounting said enclosure.

2. The lamp of claim 1 wherein said means for mounting said enclosure permit intentional demounting of said enclosure.

3. The lamp of claim 1 wherein said battery means are triple A batteries, electrically connected in series.

4. The lamp of claim 1 wherein said enclosure means for mounting said enclosure comprise lugs that snap resiliently into channels in said enclosure.

5. The lamp of claim 5 wherein said means for mounting said enclosure comprise tabs spaced along edges of said cavities opposite said hinge, said tabs having lugs at free edges of said tabs, said lugs extending into channels in said enclosure when said body and enclosure are assembled.

6. The lamp of claim 5 wherein said tabs and said enclosure are the sole means for holding said body cavities closed.

7. The lamp of claim 1 wherein a strip of one element of a hook and loop fastener is mounted on a flat back side of said lamp body.

8. The lamp of claim 7 wherein the element or,he strip of fastener material mounted on said body is the hooked element.

9. The lamp of claim 5 wherein said hinge is integral with said cavities, the entire body is made in one piece and the enclosure is made in one piece.

10. The lamp of claim 1 including detent means for inhibiting accidental sliding of said enclosure with respect to said body.

11. A portable electric lamp comprising a front and back surfaces and containing battery means to power lamp bulb, an enclosure having a light-transmitting lens portion, said enclosure housing said lamp bulb, means for mounting said enclosure for sliding movement with respect to said body, and switch means responsive to said sliding movement to connect said bulb electrically to said battery means, said switch means including a lamp holding strip of conductive material with a socket for receiving said lamp and a contact positioned to make and break contact with a terminal of said battery means, said strip being mounted in said enclosure and said contact extending into said body, said strip and its contact being fixed against movement with respect to said enclosure, and said contact being moved between make and break positions by said sliding movement of said enclosure with respect to said body., and an elongated lamp base contact strip mounted in said body and fixed against lengthwise shifting with respect to said body, said lamp base contact strip being continuously biased into engagement with a base terminal of said lamp and being electrically connected to another terminal of said battery, said lamp base terminal being moved lengthwise along said lamp base contact strip in response to said sliding movement of said enclosure with respect to said body.

12. The lamp of claim 11 including a third, bridging strip mounted in said body and bridging between terminals of said battery means of opposite polarity to connect electrically a plurality of individual batteries making up said battery means.

13. A purse light comprising a body flat on front and back surfaces and containing a pair of AAA batteries to power a lamp bulb, an enclosure having a light-transmitting lens portion, said enclosure housing said lamp bulb, means for mounting and dismounting said enclosure for sliding movement with respect to said body, and switch means responsive to said sliding movement to connect said bulb electrically to said battery means, said body being made of plastic and formed of two cavities with a hinge, integral with and extending along a long edge parallel to a long axis of said enclosure, said edge being on an opposite edge of said body from said means for mounting said enclosure, said means for mounting said enclosure comprising tabs spaced along edges of said cavities opposite said hinge, said tabs having lugs at free edges of said tabs, said lugs extending into channels in said enclosure when said body and enclosure are assembled, said lugs being sized relative to said channels to permit sliding of said enclosure with respect to said body, and complementary detent means in said enclosure and on one of said tabs for inhibiting accidental sliding of said enclosure with respect to said body, said tabs and said enclosure being the sole means for holding said body cavities closed, said switch means including a lamp holding strip of conductive material with a long reach in which a socket is provided for receiving said lamp and a contact at one end of said reach and positioned to make and break contact with a terminal of one of said batteries, said lamp holding strip being mounted in said enclosure and said strip and its contact being fixed against movement with respect to said enclosure, and said contact being moved between make and break positions by said sliding of said enclosure with respect to said body, said switch means being a part of an electric circuit comprising a lamp base contact strip of conductive material fixedly mounted in said body generally parallel to the long reach of said lamp holding strip and in a position resiliently to engage a terminal in the base of said lamp and with a battery contact part positioned constantly to engage a terminal of one of said batteries of opposite polarity from the terminal engaged by said lamp holding strip and a third, bridging strip mounted in said body and bridging between terminals of said batteries of opposite polarity to connect electrically the two batteries, said circuit, including said switch, being entirely within said body and enclosure, the entire purse light, except for the batteries and bulb, including said body, enclosure, switch and electrical circuit consisting solely of two plastic pieces and three metal pieces.

* * * * *